US006065885A

United States Patent [19]

Bodapati et al.

[11] Patent Number: 6,065,885

[45] Date of Patent: May 23, 2000

[54] PRINTABLE MEDIA CARRIER FOR USE WITH STANDARD SHEET FEED PRINTERS

[75] Inventors: Chandra Bodapati, 19900 Saraglen Ct., Saratoga, Calif. 95070; David I. Cullumber, Fremont, Calif.

[73] Assignee: Chandra Bodapati, Saratoga, Calif.

[21] Appl. No.: 09/009,651

[22] Filed: Jan. 20, 1998

[51] Int. Cl.[7] ..... B41S 13/24

[52] U.S. Cl. ..... 400/622

[58] Field of Search ..... 400/719, 622, 400/521, 522, 535, 525, 529, 530, 531, 542, 543, 645; 101/474

[56] References Cited

U.S. PATENT DOCUMENTS

| | | | |
|---|---|---|---|
| 1,688,264 | 10/1928 | Carpenter | 400/522 |
| 2,052,583 | 9/1936 | Sherman | 400/520 |
| 2,828,848 | 4/1958 | Symonds | 400/544 |
| 4,487,645 | 12/1984 | Weston | 156/157 |
| 4,636,099 | 1/1987 | Goldstone | 400/531 |
| 4,790,475 | 12/1988 | Griffin | 400/522 |
| 4,822,017 | 4/1989 | Griesmyer | 271/2 |
| 4,869,485 | 9/1989 | Enix | 400/622 |

*Primary Examiner*—John S. Hilten
*Assistant Examiner*—Amanda B. Sandusky
*Attorney, Agent, or Firm*—Claude A. S. Hamrick; Oppenheimer, Wolff & Donnelly

[57] ABSTRACT

An improved reusable media carrier having positive alignment capability and improved carrying characteristics for advancing one or more pieces of printable card stock media or the like through a computer printer, word processing printer, or copy machine. Such means is in the form of a flexible rectangularly configured carrier, particularly suited for use with printers or copy machines having friction, sheet-feed mechanisms. The carrier is comprised of an essentially rectangular sheet of paper or other flexible material folded in such a way as to provide retainers for positively engaging at least two adjacent side edges of a piece of media to be printed. In addition, the retainer means may include hard stops for effecting positive media alignment and location. Furthermore, the carrier may include embedded strips of stiffener material for minimizing curl of the media carrier. Still further, low friction coatings or materials may be added in the vicinity of the retainers to ease insertional engagement with the media, and high friction treatments, coatings or materials may be added to surface areas of the carrier lying beneath the carried media to prevent movement thereof during the printing operation.

15 Claims, 9 Drawing Sheets

PRINTABLE MEDIA CARRIER FOR USE WITH STANDARD SHEET FEED PRINTERS

BACKGROUND OF THE INVENTION

1. Field of the Invention

The present invention relates generally to print media positioning and carrying means and more particularly, to an improved media carrier for handling printable card stock substantially smaller in size than the sheet stock normally used in the printer, whereby items such as labels, address cards, index cards, postcards, invitation cards, greeting cards and other relatively small items of print media hereinafter referred to as "cards", "card media" or "print media") may be advanced through a computer printer, a word processor printer, or a copy machine.

2. Discussion of the Prior Art

Modern word processing systems typically include computer work stations linked to high-speed printers that provide efficient production of documents consisting of one or more sheets of paper of a size and shape for which the carrier and sheet-feed mechanism of a particular printer were designed to accomodate. Most such printers use automatic feeders that are designed to handle only a few sizes of paper, typically including letter size, legal size and perhaps one larger size. It is normally not possible to print on smaller sized paper or plastic objects without using of some type of perforated or peel-off stock sheets which are primarily intended for use when a large number of printed objects are required It is therefore a common practice for offices that use word processing systems to provide one or more conventional or specialized typewriters for the sole purpose of typing onto order labels, mailing labels, address cards, index cards, postcards, envelopes, checks and other relatively small sheets of paper. This, of course, requires additional capital costs, perhaps part time utilization of costly equipment, increased maintenance expense, and usually results in inconvenience and inefficiency on the part of the typist. It has therefore become desirable to provide a means for transporting small cards and labels, etc. through a printer or copy machine and perhaps increase their use.

One prior art solution is presented by U.S. Pat. No. 4,822,017 to Griesmyer, and includes an essentially rectangular sheet of paper, or the like, having at least one strip of non-setting, non-drying, pressure sensitive, tacky adhesive exposed on its top surface. The carrier sheet is of a size, typically 8½ inches by 11 inches, that the sheet-feed mechanism of the computer printer or word processor printer is designed to handle. Vertical and horizontal grid lines and index numbers are printed on the top surface of the sheet so that the typist can coordinate the location of the print window with the location of the card on the carrier. In addition to the adhesive strips, means are disclosed for holding the edges of the card-shaped items flat on the carrier sheet. In the disclosed embodiment, such means include left hand and right hand vertical retaining strips affixed to the top surface of the rectangular carrier. In a second embodiment intended for carrying two columns of one or more of such card stock, a central, vertical retaining strip is affixed to the rectangular carrier. The inner vertical edges of the left hand and right hand vertical retaining strips, and both vertical edges of the central vertical retaining strip are free to receive the outer edges of the card stock to hold them flat against the carrier sheet. The strips of adhesive are disposed between the vertical retaining strips. In these embodiments, card stock to be printed is held in place by the adhesive strip while the vertical retainer edges merely cover and hold down the side edge portions of the card stock.

A disadvantage of this solution to the previously identified problem is that it relies entirely upon the integrity of the adhesive to both align and secure the card in position relative to the carrier sheet as it is pulled through the rather tortuous paper path of some modem printers. The edge retaining strips perform no alignment function and merely hold down the edges.

Another disadvantage is that although the securing adhesive may be quite effective for the first several uses, with repeated use dust, lint and other fine matter tend to stick to and build up on the adhesive, causing its bond to weaken such that a card affixed thereto may shift in position as it passes through the printer, thereby causing an imperfect print to be effected. The integrity problem of the adhesive is further compounded by the high temperatures and stresses encountered in laser printers.

SUMMARY OF THE PRESENT INVENTION

It is therefore a principal objective of the present invention to provide an improved and reusable media carrier having positive alignment capability and improved carrying characteristics for advancing one or more relatively small pieces of print media through a computer, word processor or laser printer.

Another object of the present invention is to provide a carrier of the type described having a size that can be handled by conventional, automatic sheet feeders of high-speed printers.

A further object of the present invention is to provide a carrier having means for grippingly engaging at least two adjacent edges of card media to be printed.

A still further objective of the present invention is to provide a carrier for advancing one or more pieces of material printable through a printer, such carrier having hard-stop, aligning edges for engagement by the printable media to assure accurate alignment thereof.

A presently preferred embodiment of the present invention provides means for advancing one or more pieces of printable card stock media or the like through a computer printer or word processing printer. Such means is in the form of a flexible rectangularly configured carrier, particularly suited for use with printers having friction, sheet-feed mechanisms. The carrier is comprised of an essentially rectangular sheet of paper or other flexible material folded in such a way as to provide retainers for positively engaging at least two adjacent side edges of a piece of media to be printed. In addition, the retainer means may include hard stops for effecting positive media alignment and location. Furthermore, the carrier may include embedded strips of stiffener material for minimizing curl. Still further, low friction coatings or materials may be added in the vicinity of the retainers to ease insertional engagement with the media, and high friction treatments, coatings or materials may be added to surface areas of the carrier lying beneath the carried media to prevent movement thereof during the printing operation. The materials used maintain their integrity at temperatures prevailing in laser printers.

A principal advantage of the present invention is that it provides a relatively inexpensive solution to the problem of passing small sized print media through a standard friction-feed printer.

Another advantage of the present invention is that it includes means for facilitating positive location and retention of card media to be printed.

Still another advantage of the present invention is that it provides a reusable carrier means that can be folded to allow its insertion into an envelope-type printer feeder.

These and other objects and advantages of the present invention will no doubt become apparent to those skilled in the art after having read the following detailed description of the invention illustrated in the several figures of the drawing.

IN THE DRAWINGS

Figure 2:
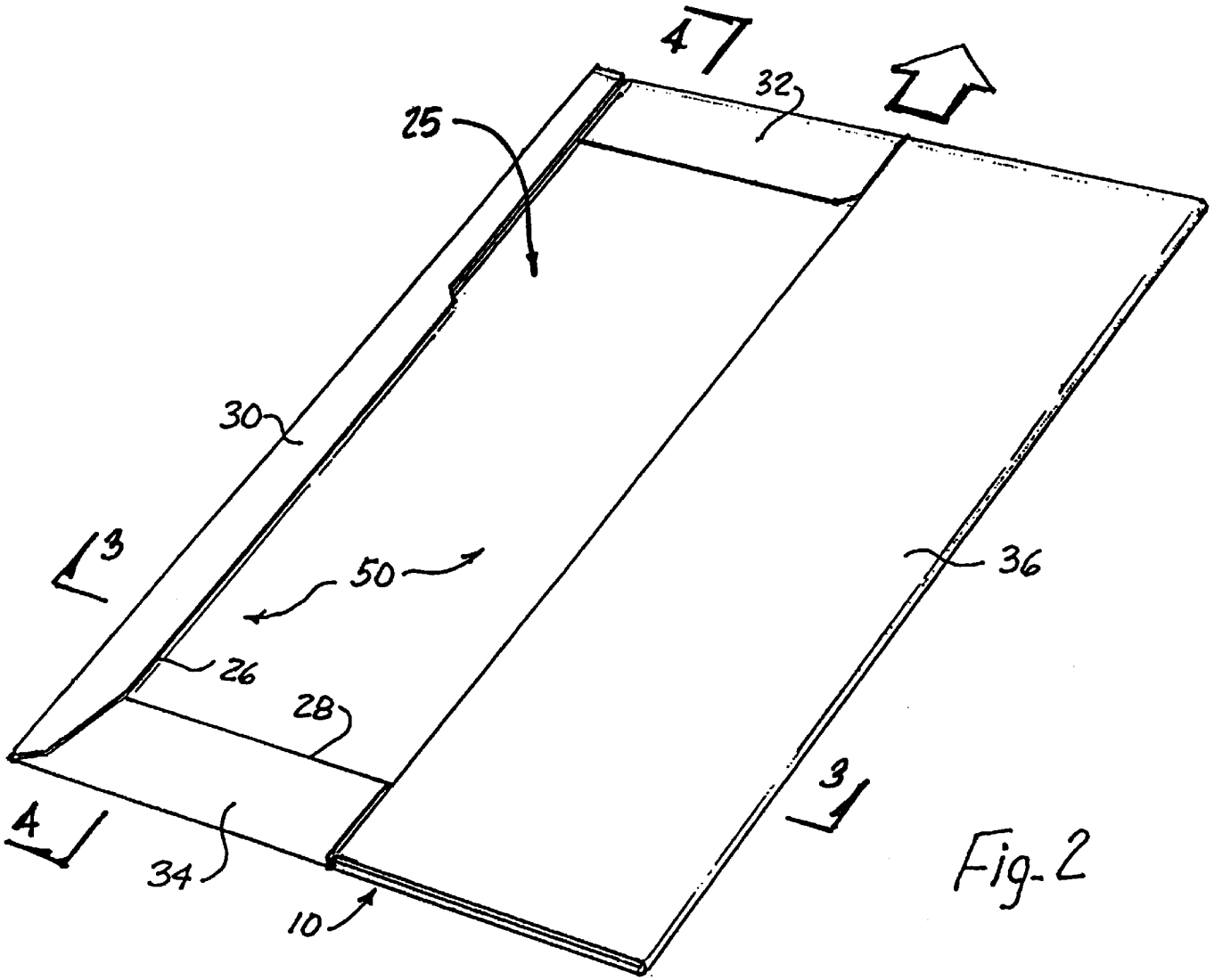
FIG. 2 is a perspective view showing a seat carrier in accordance with the present invention.
Figure 3A:
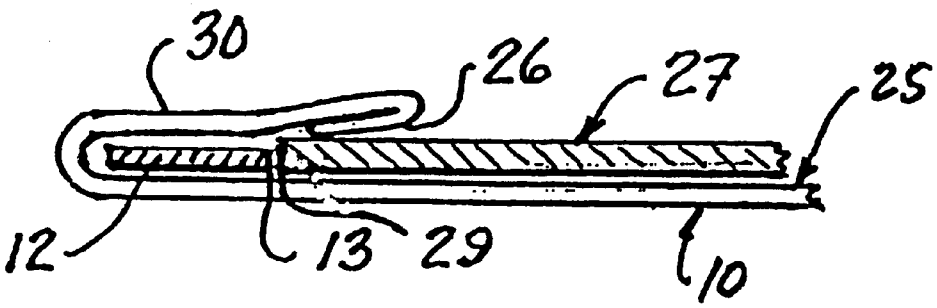
Figure 3:
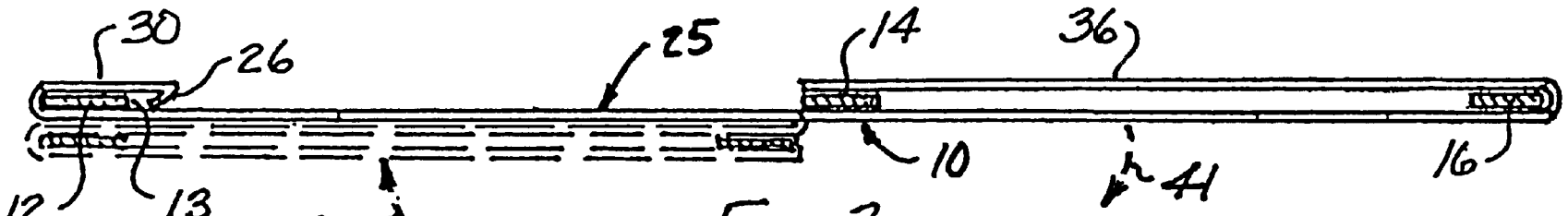

FIGS. 3 and 3*a* are a transverse cross-section taken along the line 3—3 of FIG. 2.

Figure 4:
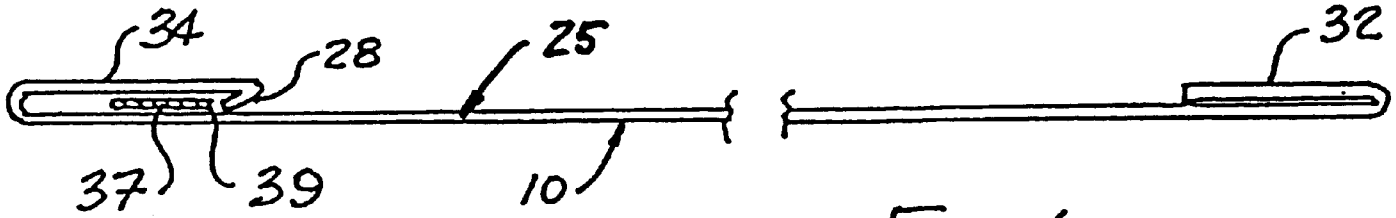

FIG. 4 is a longitudinal cross-section taken along the line 4—4 of FIG. 2.

Figure 5:
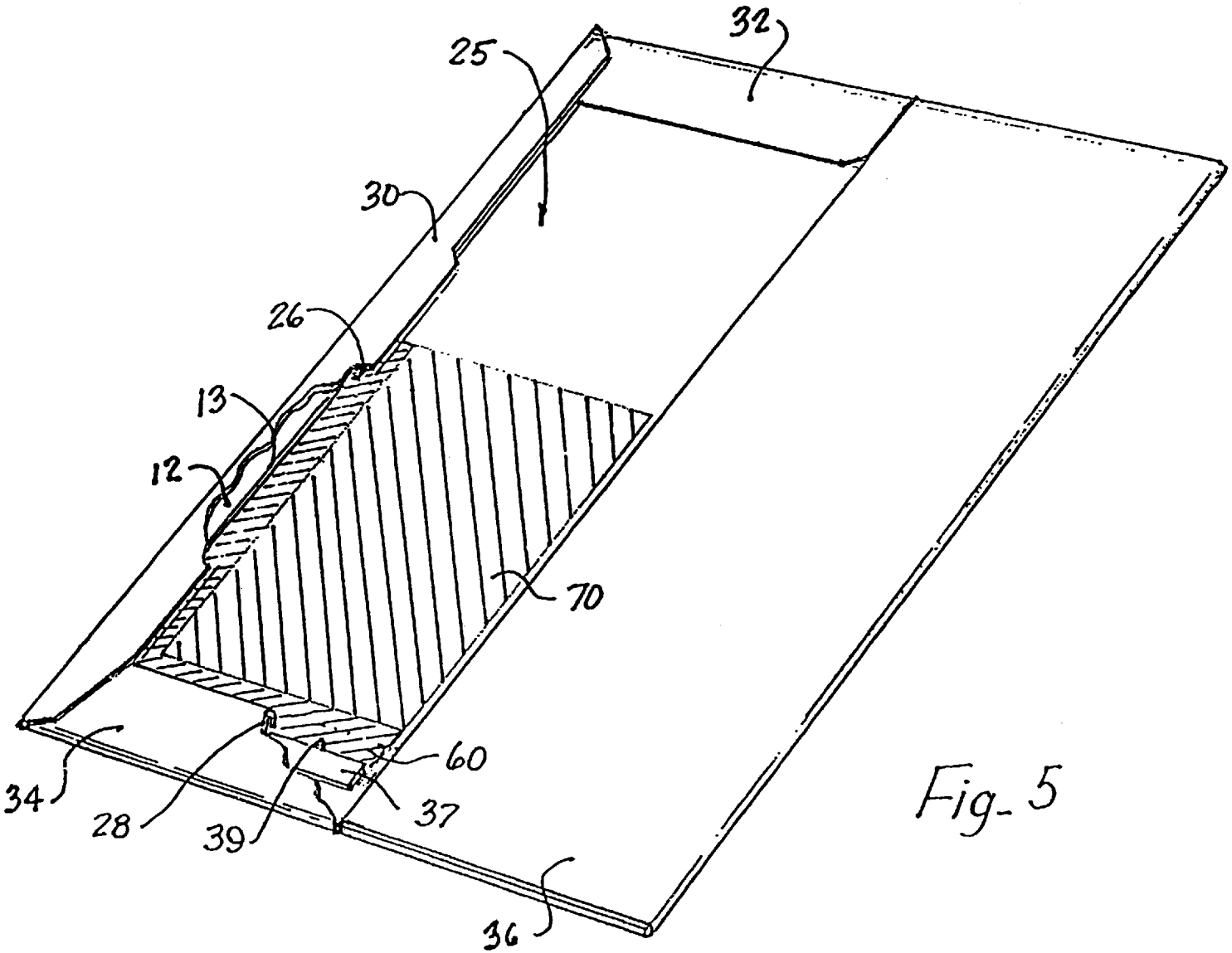

FIG. 5 is a perspective view of a carrier in accordance with the present invention broken to show interior features and additional materials forming a part thereof.

Figure 6:
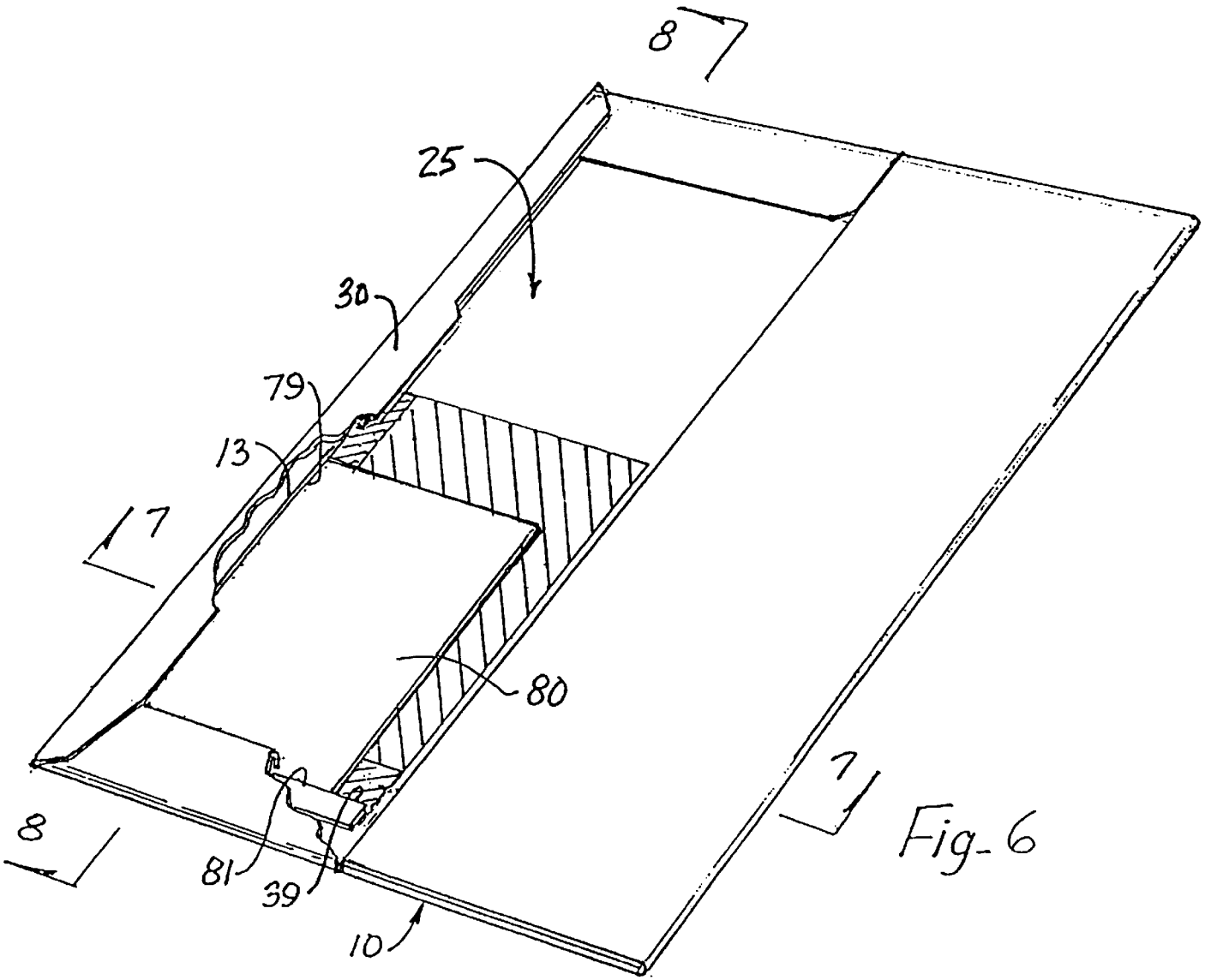

FIG. 6 is a perspective view of the carrier of FIG. 5 showing a card in place for printing.

Figure 7:
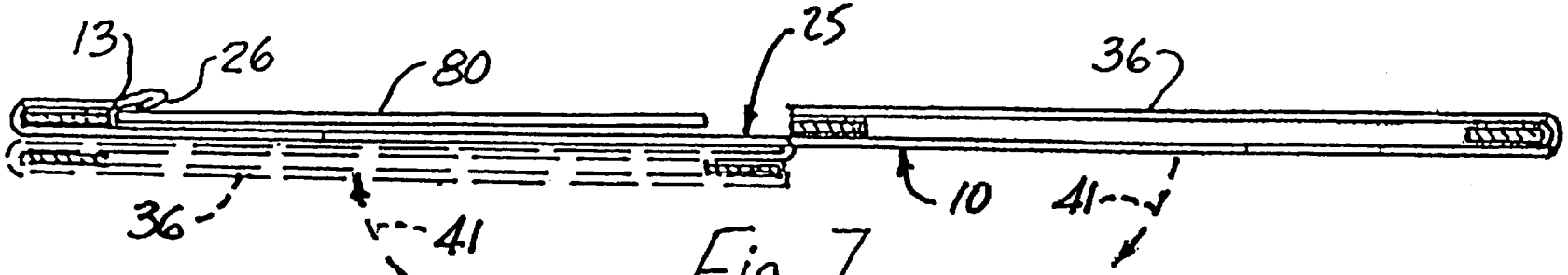
Figure 8:
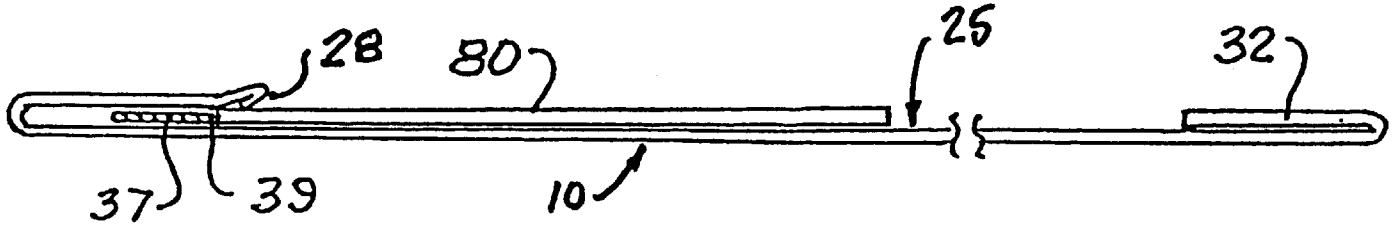

FIGS. 7 and 8 are cross sections taken along the lines 7—7 and 8—8 in FIG. 6

Figure 9:
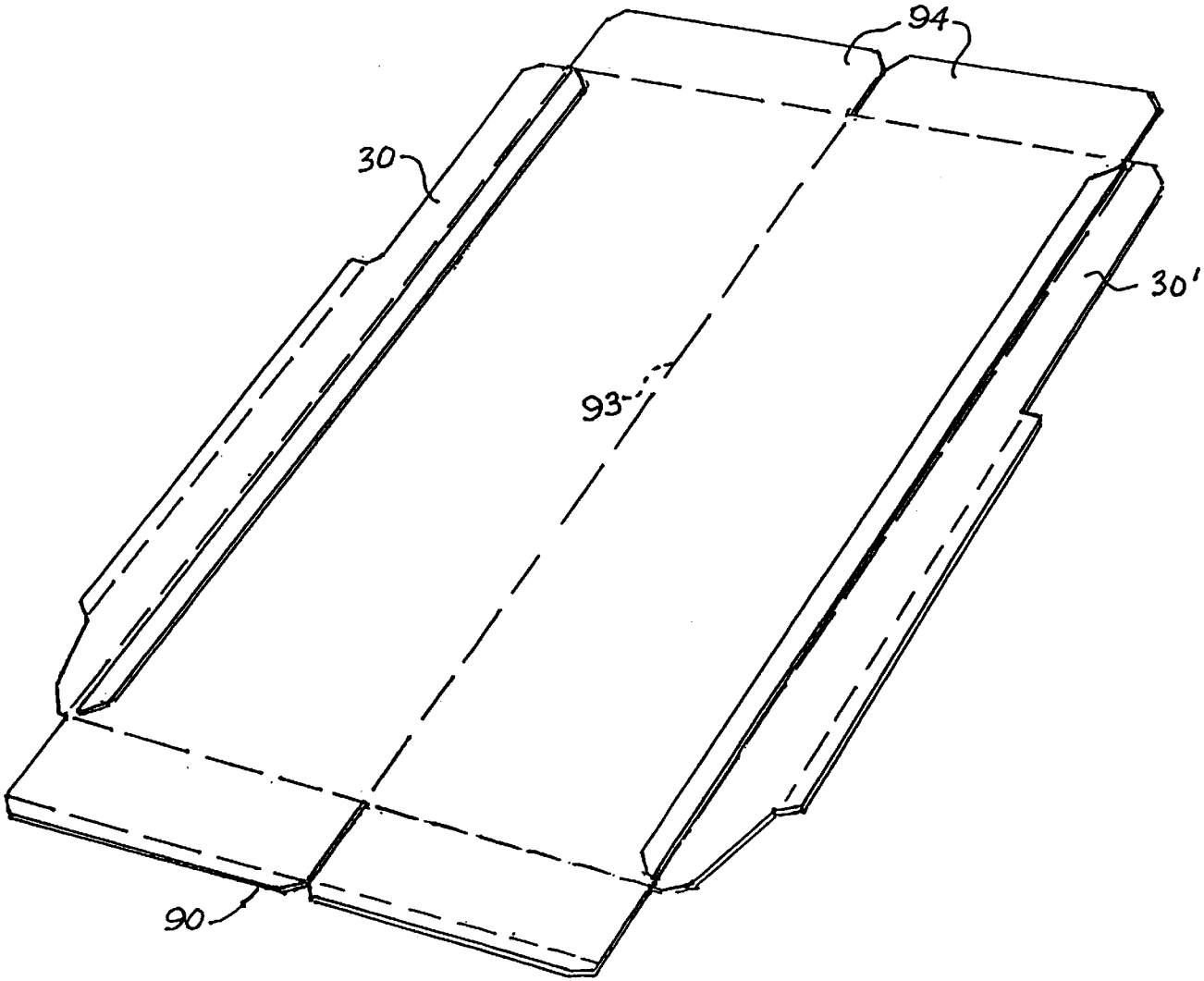
Figure 10:
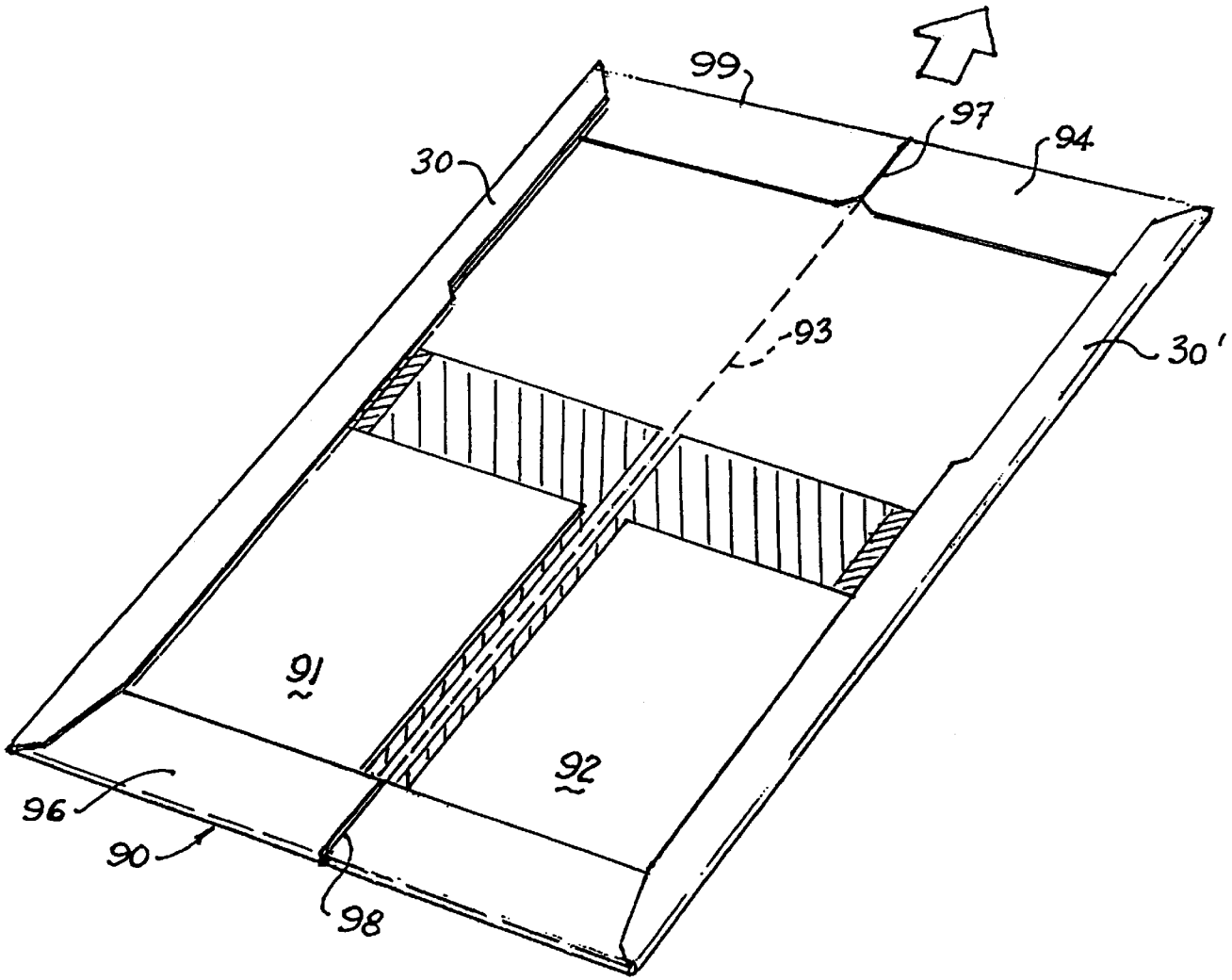

FIG. 9 is a perspective view illustrating a trimmed carrier sheet in accordance with an alternative embodiment of the invention; and FIG. 10 is a perspective view illustrating the alternative embodiment using the trimmed sheet of FIG. 9.

FIGS. 11, 12, 13 and 13*a* depict another alternative embodiment of the present invention.

DETAILED DESCRIPTION OF THE PREFERRED EMBODIMENTS

Figure 1:
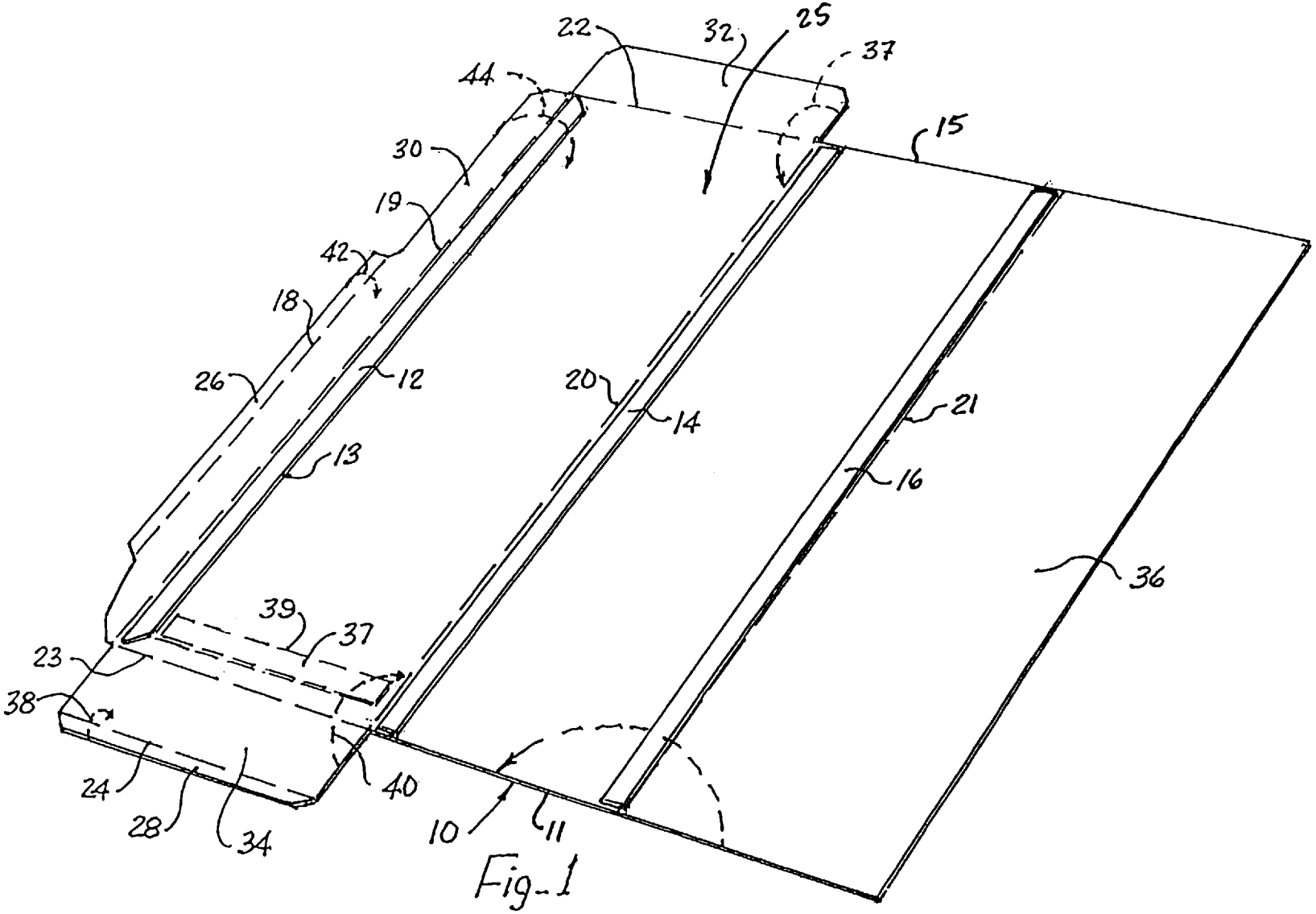
FIG. 1 is a perspective view showing a pre-trimmed blank piece of material used to form a preferred embodiment of the present invention.

Referring now to FIG. 1 of the drawings, the physical makeup of a carrier in accordance with a first embodiment of the invention is shown to include a trimmed piece of sheet stock 10 having as positioned thereon three stiffener strips 12, 14 and 16 of resilient metallic or plastic material. The strips must be capable of withstanding temperatures as high as 300° F. without loosing their resiliency. Furthermore, they must be pliable enough to endure substantial bending and flexing as the carrier is passed over a tortuous path through a printer or copy machine. Drawn across the sheet are dashed fold lines 18, 19, 20, 21, 22, 23, 24. The fold lines 19, 21, 22 and 23 together with the sheet edges 11 and 15 define a carrier base 25 to which the resilient strips and flaps will be secured. Lines 18 and 24 define capture tabs 26 and 28, while dashed lines 19, 22 and 23 respectively define fold lines and the inner limits of a side fold flap 30, a leading edge fold flap 32, and a trailing edge fold flap 34. Dashed line 21 defines the inner limit of a right side fold flap 36 and line 20 defines a center line of the completed carrier as will be further described below.

The sheet 10 may be made of any suitable paper, plastic or metallic material flexible enough to compliantly follow the tortuous paper paths encountered in modern printers and copy machines without experiencing permanent distortion. It may also be thin and have the ability to withstand the high temperatures used to fix the print toners to the paper. The material should be treated or coated with a material designated to resist toner adherence.

In assembling the illustrated embodiment, the resilient strips 12, 14 and 16 are first affixed to the upper surface of base 25 by means of a suitable adhesive. A stop strip 37 having a stop forming edge 39 may also be adhesively affixed to the base as indicated. Flap 32 is then folded along line 22 as indicated by the dashed arrow 37. Next, retainer tab 28 is folded about line 24 as indicated by the dashed arrow 38, and flap 34 is folded about line 23 as suggested by the arrow 40. Retainer tab 26 is folded about line 18, as indicated by the arrow 42, and subsequently the entire side of flap 30 is folded about line 19 as suggested by the dashed arrow 44. As a final step, side flap 36 is folded about dashed line 21. Suitable adhesives may be utilized in appropriate places to hold the various flaps in place.

Turning to FIG. 2 of the drawing, a completed assembly of the preferred embodiment is depicted wherein the sheet 10 of FIG. 1 is now transformed into the carrier 10. In this configuration, a card carrying region 50 of base 25 is defined having retainer means formed by the inwardly folded tabs 26 and 28, which are alternatively depicted in more detail in the cross-sections of FIGS. 3 and 4 taken along the lines 3—3 and 4—4 respectively of FIG. 2. The dashed lines in FIG. 3 illustrate the fact that if one should desire to use the carrier in an envelope size printer, he need merely fold the carrier along its mid-line, as suggested by the dashed arrows, so as to present a plan form half as wide as the full size sheet carrier. Note in FIG. 3 that the edge 13 of strip 12 forms an aligning edge stop cooperating with the inwardly folded retainer tab 26, and the edge 39 of stop piece 37 forms a card engaging alignment stop cooperating with the inwardly folded retainer tab 28. it will be appreciated that the intersection of edges 13 and 39, or extensions thereof, define a reference point at "P" having a known, or predetermined, position on the base 25 and a known distance from the leading edge "LE" and side edge "SE" (as well as trailing edge "TE"). The relative position of the point P will enable an appropriately programmed printer controller to cause the printing of design information and/or graphics at predetermined locations and orientations on a card media carried by the carrier.

FIG. 3*a* is an enlarged cross-sectioned view showing in more detail, the function of edge capture tab 26. In this view, an edge 29 of a card 27 to be carried by the device is shown slipped in under tab 26 and into engagement with the edge stop 13. Although not shown, it will be appreciated that a similar engagement occurs between tab 28 and an adjacent edge of card 27. As is apparent from this figure, the tab 26 and the overlaying portion of flap 30 are deformed upwardly as the card edge 29 is admitted therebeneath. And since the folded tab 26 is somewhat resilient, it will react by exerting a downward force on the top of the card edge tending to positively capture the card edge and help to retain the card in place on the carrier. The capture function is further enhanced by engagement of flap 30 with the sheet feed mechanism of the printer or copier which tends to exert a downwardly acting clamping force onto flap 30 that is transferred, at least in part, through tab 26 to card edge 29. As a consequence, the card will be firmly gripped and held in alignment with the carrier as it is pulled through the printer or copier.

In FIG. 5, which is broken away to reveal internal detail, a further feature of the present invention is illustrated and includes the provision of a low friction coating 60 on the base 25 in the capture regions beneath and adjacent to the retainer tabs 26 and 28. Such coating or other surface treatment facilitates the insertion of a card beneath the tabs and into engagement with the stop edges 13 and 39 respectively. Disposed outwardly from the low friction border 60, a high friction zone 70 may be provided to help prevent media movement during the printing operation. The border 60 may be treated with a suitable spray or film coating capable of providing an enhanced lubrication of the surface without staining, discoloring or otherwise interfering with the card to be printed. The region 70 may be provided by spraying a film of rubberized material onto the surface, or perhaps by texturing, or roughening the surface with an abrasive so as to make the frictional characteristics of the region 70 substantially greater than that of other surfaces of base 25. In either case, the objective is to provide means for enhancing both the entry of the card beneath the capture tabs and into alignment with the edge stops, and then to provide means for preventing movement of the media relative to the carrier once it is in place in the carrier as well as during the entire passage of the carrier through the tortuous path of the printer.

In FIG. 6, a small card 80 is shown positioned on the carrier 10 ready for printing. Note that the left most edge 79 of card 80 abut edge stop 13, and the bottom most edge 81 of card 80 abuts edge stop 39. With the card so placed, the carrier 10 may now be inserted into a copy machine/computer printer and be fed therethrough to copy/print any desired form of print or graphics onto card 80. Cross-sections taken along lines 7—7 and 8—8 in FIG. 6 are depicted in FIGS. 7 and 8 respectively, and show the card 80 captured beneath the retainer tabs 26 and 28, and in abutment with edge stops 13 and 39 respectively. Note that, as depicted in FIG. 7, the right most half of the carrier, including flap 36, may be rotated downwardly, as suggested by the dashed arrows 41, and folded back at dashed line 20 against the left most half so as to provide a carrier for use in letter size printing apparatus.

It will of course be appreciated that a dual card carrier could be implemented by simply repeating the left side fold configuration (12, 30) on the right side ('12, '30) in place of the large flap 36 as depicted in FIG. 9, so that when folded and fastened, a carrier such as that illustrated at 90 in FIG. 10 would be provided, whereby two cards 91 and 92 could be simultaneously transported through a printer for printing. In this embodiment, the flexible center strip (not shown) may be omitted and the centerfold line 93 may be included or omitted. If no fold capability is to be provided, the leading edge flaps 94 and trailing edge flaps 96 would preferably be made continuous across the leading and trailing edges ("LE" and "TE" respectively) of the carrier rather than being bifurcated at 97 and 98 as depicted.

It will also be appreciated that if the edge stops 13 and 39 are positioned with precision relative to the outer edges of carrier 10, and particularly with respect to the leading edge 99, appropriately configured printing software can very accurately register print on a carried card or cards without requiring grid lines, scales or other fiducials.

Figure 12:
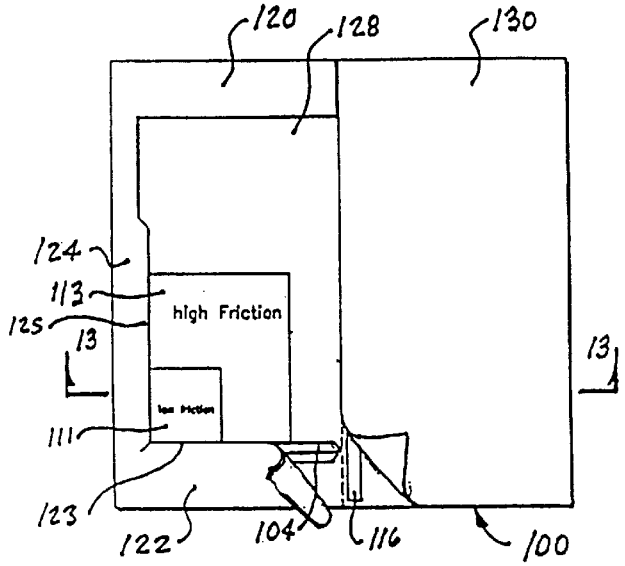
Figure 11:
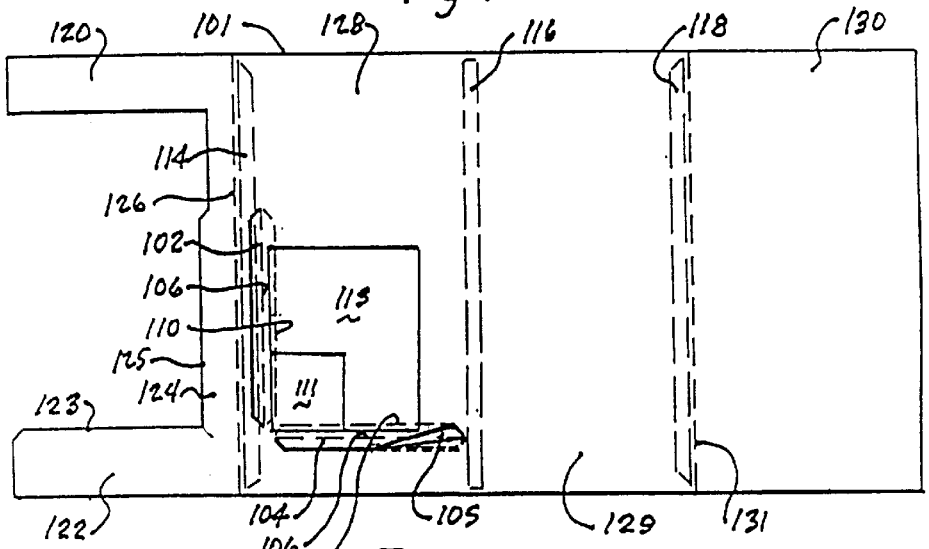
Figure 13A:
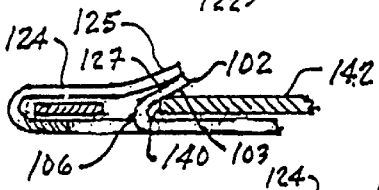
Figure 13:
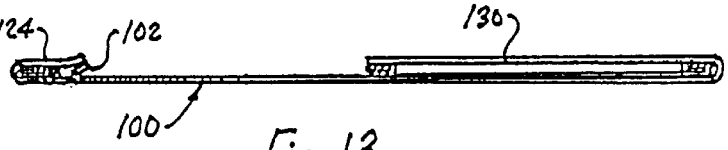

Referring now to FIGS. 12–13, a further embodiment of the invention is illustrated, first in unfabricated die-cut, sheet form in FIG. 11, and then in assembled form in FIG. 12. This embodiment differs from that first above described in that the assembled carrier 100 shown in FIG. 12 is made from a slightly different form of starting sheet 101, as depicted in FIG. 11, such that only four folds are required instead of the six folds of the first embodiment In addition, the edge stop and capture tab detail is slightly different from that of FIGS. 1–8. Moreover, a different layout of low friction surface region (111) and high friction surface region (113), as compared to that of the FIG. 5–6 embodiment, is shown.

Assembly of this carrier starts by first folding the die-cut edge stop tabs 102 and 104 about the dashed fold lines 106 and 108 respectively, into the positions illustrated by the dashed lines 110 and 112 in FIG. 11. Three resilient stiffener strips are then affixed to the sheet 101 in the positions illustrated by the dashed lines 114, 116 and 118. The leftmost panel of sheet 101 intended to collectively form a leading edge flap 120, a trailing edge flap 122 and a side flap 124, is then folded about dashed fold line 126 and secured to panel 128 by a suitable adhesive. Note that, as illustrated in more detail by the cross-sections of FIG. 13 taken along the line 13—13 of FIG. 12, and the enlarged portion thereof, as shown in FIG. 13*a,* the lower surface of the laterally extending extremity 125 of flap portion 124 is affixed to the upper surface 127 of tab 102. And similarly, though not shown in detail, the uppermost extremity 123 of flap portion 122 is likewise affixed to the upper surface 105 (FIG. 11) of the tab 104 shown partially folded. Flap 120 is also affixed to the leading edge portion of panel 128. The assembly is then completed by folding the rightmost panel 130 about the fold line 131 and adhesively affixing it to the panel.

Referring now specifically to the enlarged, partial cross-section shown in FIG. 13*a,* it will be noted that the folded tab 102 (and similarly the orthogonally disposed tab 104) serves the dual purpose of providing both card edge stop means and card edge capture means. More particularly, the portion of tab 102 nearest the fold line 106 serves as a stop for engagement by edge 140 of a card 142, and the lower surface 103 of the tab provides a capture function, and is particularly effective when the flap 124 is engaged by the feed mechanism of the printer or copier as the carrier is pulled through the machine.

As with the previously described embodiment, this carrier configuration will receive a card having two of its orthogonally disposed edges tucked under the tabs 102 and 104 and will carry the card through a printer or copy machine with no relative displacement occurring between card and carrier during transit As in the early described embodiments, the low friction region 111 facilitates card insert, while the high friction region assists in preventing dislodgement of the card as it is carried through the copier or printer.

Although at present the preferred embodiment of the present invention has been described above, it will be appreciated that certain operations and modifications thereof may become apparent to those skilled in the art after having read the above disclosure. It is therefore intended that the appended claims be interpreted broadly and in accordance with the truth, spirit and scope of the invention.

What is claimed is:

1. A flexible and reusable carrier for transporting at least one item of small size card media through a printer or copy machine having a feed mechanism normally intended to advance therethrough only standard size sheets of print media comprising:

at least one piece of sheet material including a base portion forming a generally rectangular planar base having outer dimensions suitable for cooperative engagement with the sheet feeder mechanisms of a standard sheet fed printer or copy machine, said base having a leading edge, a trailing edge and a pair of opposite side edges;

a first side portion folded and affixed to said base portion and forming a first card media edge engaging and capturing means disposed proximate to and extending along at least a substantial portion of one side of said base; and a trailing edge portion folded and affixed to said base portion and forming a second card media edge engaging and capturing means disposed proximate to and extending along at least a substantial portion of said trailing edge of said base, an extremity of the folded first side portion and an extremity of the folded trailing edge portion respectively forming said first and second card media edge engaging and capturing means, said first and second card media edge engaging and capturing means, or extensions thereof, intersecting proximate a trailing edge of said base and defining a reference point on said base relative to said leading edge whereby an appropriately programmed printer controller will be capable of printing desired information and/or graphics on a card media carried by said carrier, and a first elongated resilient member affixed to said base forming portion and covered by said folded first side portion, said resilient member serving as a means for aiding in restoring the planarity of said base following any deformation thereof as it is passed through a printer or copy machine.

2. A flexible carrier as recited in claim 1 wherein said sheet material further includes a leading edge portion opposite said trailing edge portion, said leading edge portion being folded and affixed to said base forming portion to form a leading edge stiffener.

3. A flexible carrier as recited in claim 1 wherein said sheet material further includes a second side portion opposite said first side portion, said second side portion being folded and affixed to said base forming portion to form a side edge stiffener.

4. A flexible carrier as recited in claim 2 wherein said sheet material further includes a second side portion opposite said first side portion folded and affixed to said base forming portion to form a side edge stiffener.

5. A flexible carrier as recited in claim 1 and further comprising a second elongated resilient member affixed to said base forming portion and covered by a second side portion, said second resilient member serving as an additional means for aiding in restoring the planarity of said base following any deformation thereof as it is passed through a printer or copy machine.

6. A flexible carrier as recited in claim 4 and further including a second elongated resilient member affixed to said base forming portion and covered by said folded second side portion, said second resilient member serving as an additional means for aiding in restoring the planarity of said carrier following any deformation thereof as it is passed through a printer or copy machine.

7. A flexible carrier as recited in claim 1 wherein said carrier is formed of sheet material selected from the group consisting of paper, plastic and metal materials capable of withstanding temperatures and stresses experienced in negotiating the tortuous paper path of a printer or copy machine.

8. A flexible carrier as recited in claim 6 wherein said sheet material is selected from the group consisting of paper, plastic and metallic materials capable of withstanding temperatures and stresses experienced in negotiating the tortuous paper path of a printer or copy machine.

9. A flexible carrier as recited in claim 1 wherein at least a portion of said base proximate said first and second means is coated with a lubricating material to facilitate attachment of card media to said carrier.

10. A flexible carrier as recited in claim 1 wherein at least a portion of said base proximate said first and second means is coated with a material having a frictional characteristic substantially greater than that of other portions of said base, and which serves to prevent movement of an attached card media relative to said carrier.

11. A flexible carrier as recited in claim 2 wherein said carrier is formed of sheet material selected from the group consisting of paper, plastic and metal materials capable of withstanding temperatures and stresses experienced in negotiating the tortuous paper path of a printer or copy machine.

12. A flexible carrier as recited in claim 10 wherein said sheet material is selected from the group consisting of paper, plastic and metallic materials capable of withstanding temperatures and stresses experienced in negotiating the tortuous paper path of a printer or copy machine.

13. A flexible carrier as recited in claim 12 wherein at least a portion of said base proximate said first and second means is coated with a lubricating material to facilitate attachment of card media to said carrier.

14. A flexible carrier as recited in claim 13 wherein said sheet material further includes a second side portion opposite said first side portion, said second side portion being folded and affixed to said base forming portion to form a side edge stiffener.

15. A flexible carrier as recited in claim 14 and further comprising a second elongated resilient member affixed to said base forming portion and covered by said folded second side portion, said second resilient member serving as an additional means for aiding in restoring the planarity of said carrier following any deformation thereof as it is passed through a printer or copy machine.

* * * * *